US010941666B2

(12) United States Patent
Davies

(10) Patent No.: US 10,941,666 B2
(45) Date of Patent: Mar. 9, 2021

(54) MULTI-STAGE AXIAL FLOW TURBINE ADAPTED TO OPERATE AT LOW STEAM TEMPERATURES

(71) Applicant: INTEX HOLDINGS PTY LTD, Payneham (AU)

(72) Inventor: Roger Davies, Payneham (AU)

(73) Assignee: Intex Holdings Pty Ltd, Payneham (AU)

( * ) Notice: Subject to any disclaimer, the term of this patent is extended or adjusted under 35 U.S.C. 154(b) by 0 days.

(21) Appl. No.: 16/344,201

(22) PCT Filed: Oct. 24, 2017

(86) PCT No.: PCT/AU2017/051165

§ 371 (c)(1),
(2) Date: Apr. 23, 2019

(87) PCT Pub. No.: WO2018/076050

PCT Pub. Date: May 3, 2018

(65) Prior Publication Data

US 2019/0257209 A1 Aug. 22, 2019

(30) Foreign Application Priority Data

Oct. 24, 2016 (AU) ..... 2016904316

(51) Int. Cl.

| | |
|---|---|
| ***F01D 1/04*** | (2006.01) |
| ***F01D 5/34*** | (2006.01) |
| ***F01D 1/02*** | (2006.01) |
| ***F01D 5/06*** | (2006.01) |

(Continued)

(52) U.S. Cl.
CPC ..... *F01D 5/34* (2013.01); *F01D 1/02* (2013.01); *F01D 5/06* (2013.01); *F01D 15/10* (2013.01); *F01D 17/16* (2013.01); *F05D 2220/31* (2013.01)

(58) Field of Classification Search
CPC ..... F01D 1/04; F01D 5/02; F01D 5/06; F05D 2250/51
See application file for complete search history.

(56) References Cited

U.S. PATENT DOCUMENTS 3,330,514 A * 7/1967 Williams ..... F01D 25/28 248/678
4,780,057 A * 10/1988 Silvestri, Jr. ..... F01D 17/18 415/202
5,116,200 A 5/1992 Catlow et al.
(Continued)

FOREIGN PATENT DOCUMENTS

AU 2016222342 11/2016

*Primary Examiner* — Ninh H. Nguyen
(74) *Attorney, Agent, or Firm* — Sand, Sebolt & Wernow Co., LPA

(57) ABSTRACT

A multi-stage axial turbine (typically between 4 and 10 stages) designed to operate more efficiently with partial admission of low temperature steam in each stage except the last one or two stages. Each stage of the subject turbine operates efficiently with smaller pressure drops thereby maintaining much smaller reductions in fluid density per stage. Each stage has blisks built as a single piece and the steam passages built into the periphery of the blisks. Each subsequent stage then only requires a small increase in flow area that can be achieved by using only a small increase in admission and blade height.

6 Claims, 12 Drawing Sheets

(51) Int. Cl.
*F01D 17/16* (2006.01)
*F01D 15/10* (2006.01)

(56) References Cited

U.S. PATENT DOCUMENTS

| | | | | | |
|---|---|---|---|---|---|
| 5,259,727 | A * | 11/1993 | Quinn | B23P 6/005 | 29/402.08 |
| 5,411,365 | A * | 5/1995 | Mazzola | F01D 9/047 | 415/108 |
| 5,927,943 | A * | 7/1999 | Maier | F01D 9/02 | 415/150 |
| 6,046,509 | A * | 4/2000 | LaBaire | F01D 1/026 | 290/52 |
| 6,196,793 | B1 * | 3/2001 | Braaten | F01D 9/047 | 415/191 |
| 6,203,274 | B1 * | 3/2001 | Kikuchi | F01D 5/02 | 415/191 |
| 6,443,695 | B2 * | 9/2002 | Kikuchi | F01D 25/243 | 415/149.2 |
| 7,507,073 | B2 * | 3/2009 | Burdgick | F01D 5/147 | 29/889.71 |
| 7,766,625 | B2 * | 8/2010 | Burdgick | F01D 5/16 | 416/190 |
| 8,739,539 | B2 | 6/2014 | Tecza | | |
| 2010/0111669 | A1 | 5/2010 | Hays et al. | | |

* cited by examiner

MULTI-STAGE AXIAL FLOW TURBINE ADAPTED TO OPERATE AT LOW STEAM TEMPERATURES

FIELD OF THE INVENTION

The present invention relates generally to an axial turbine with multiple stages operating at relatively low steam temperatures and pressures and where there is partial steam admission at most of the stages.

BACKGROUND TO THE INVENTION

Existing steam turbines are typically large, generating 100 kW+ to overcome losses and be financially viable. Expansion of steam requires increase in flow area in multiple stage axial and radial designs, while high pressure, temperatures and rotational velocity limit materials selection. Large size and generally horizontal configuration requires that the shaft be supported along the axial direction. Rotating blade rows (rotors) must be separated by stationary nozzle rows (stators), increasing complexity of assembly.

The development of power generation devices over the years which use steam as a motive fluid has primarily been focused on reducing the monetary cost per MW-hour of electricity generated. To that end, improvements in steam turbine technology have been focused on increasing the output, steam/boiler temperature, unit reliability/availability, or a combination of these. These improvements generally add to the unit cost, necessitating an increase in power output to remain fiscally viable.

An axial turbine stage is comprised of a stationary row of airfoils (typically referred to as "nozzles", "stators" or "vanes") that accelerate and direct the fluid flow to impinge against a rotating row of airfoil shapes (typically referred to as "buckets", "rotors" or "blades") which are connected to a shaft for delivering power output to a connected device.

The current problems with known axial turbines is that with an increase in passage area to handle the expansion of steam through an increase in blade height increases the tip speed at later stages and increases the circumferential velocity differential between blade tip and root, changing the operating conditions to the point that a 3-D blade profile is required.

Blade materials also need to be heavy and are thus expensive in order to handle the thermal and mechanical conditions. Given that the blades have a different 3-D profile means that the blades have to be manufactured individually and then separately attached to a carrier hub greatly increasing assembly time, complexity and balancing issues.

In addition, in order to limit radial deflection, the shaft is generally supported by a bearing in each stator increasing the bearing drag with each additional stage leading to losses.

Furthermore to facilitate assembly of multiple stages, the housing is generally split along its axial length and the stator halves fixed into each housing part, increasing sealing complexity and difficulty of alignment.

When the fluid density is very high at turbine inlet it is common practice to design the first stage (and possibly the first few stages) of a multi-stage turbine, with "partial admission". Partial admission refers to a stage design where nozzle passages are only provided for a portion (segment) of the 360 degree circumference. The main advantage of partial admission as used in conventional designs is that it enables the use of larger nozzle and blade passage heights (i.e., radial lengths) resulting in better efficiency due to reduced losses. This is especially important for high density flows that require very small heights. However, the partial admission feature has several other benefits that are exploited in the present invention as discussed below.

In conventional turbines, particularly steam turbines, partial admission is only applied to the first stage (or first few stages) that operate with high density fluid. Subsequent stages cannot utilize partial admission because their operating pressure and density has been significantly reduced. As a result, a larger increase in nozzle and blade passage areas is required to compensate for the higher volume flow rate that occurs as the steam expands from inlet to exhaust. For these higher volume flow stages, full admission (360 degree) is typically required in order to achieve larger passage areas while maintaining blade heights within reasonable mechanical stress limits.

It is an object of the present invention to overcome at least some of the above-mentioned problems or to provide the public with a useful alternative by providing multi-stage axial flow turbine adapted to operate at low steam temperatures that can be operated in an apparatus as described in the applicants Australian patent application 2016222342 whose contents are incorporated by reference herein.

SUMMARY OF THE INVENTION

In one form of the invention there is proposed an axial flow turbine for generation of electrical power having multiple stages and configured for operation at low absolute pressure with the motive fluid being steam, the turbine comprising:

a first stage having a partial admission inlet, each subsequent stage increasing the amount of steam admission until complete admission is achieved towards the final stages;

each stage having blisks made as a single piece and the steam passages built into the periphery of the blisks.

In preference the first stage has a 90 degree angle.

In preference the turbine is oriented so that its major axis is generally vertical.

In preference each stage of the turbine includes a stator and a rotor, the rotor fixedly attached to a vertical shaft that is connected through a gearbox to an electrical generator.

In preference the height of each rotor increases by some 10% per stage.

In preference each stator has a set of nozzles with a 2-D profile and inlet angles of some 45 degrees.

According to a further aspect, the present invention provides an axial flow turbine which is composed of multiple stages, being configured for operation at low absolute pressure, the motive fluid being steam; the first nozzle stage being partial admission, the amount of admission increasing stage wise until complete admission is achieved in the final, or penultimate and final stages, the casing which encases blisk pairs being generally cylindrical, with no splits or seams on the axial axis and a generally constant internal bore and each blisk being made as a single piece, the steam passages being cut into the periphery of the blisk material, there thus being no seams, joins or assembly required to affix an individual blade to its carrier ring.

It should be noted that any one of the aspects mentioned above may include any of the features of any of the other aspects mentioned above and may include any of the features of any of the embodiments described below as appropriate.

BRIEF DESCRIPTION OF THE DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

DETAILED DESCRIPTION OF THE INVENTION

Figure 1:
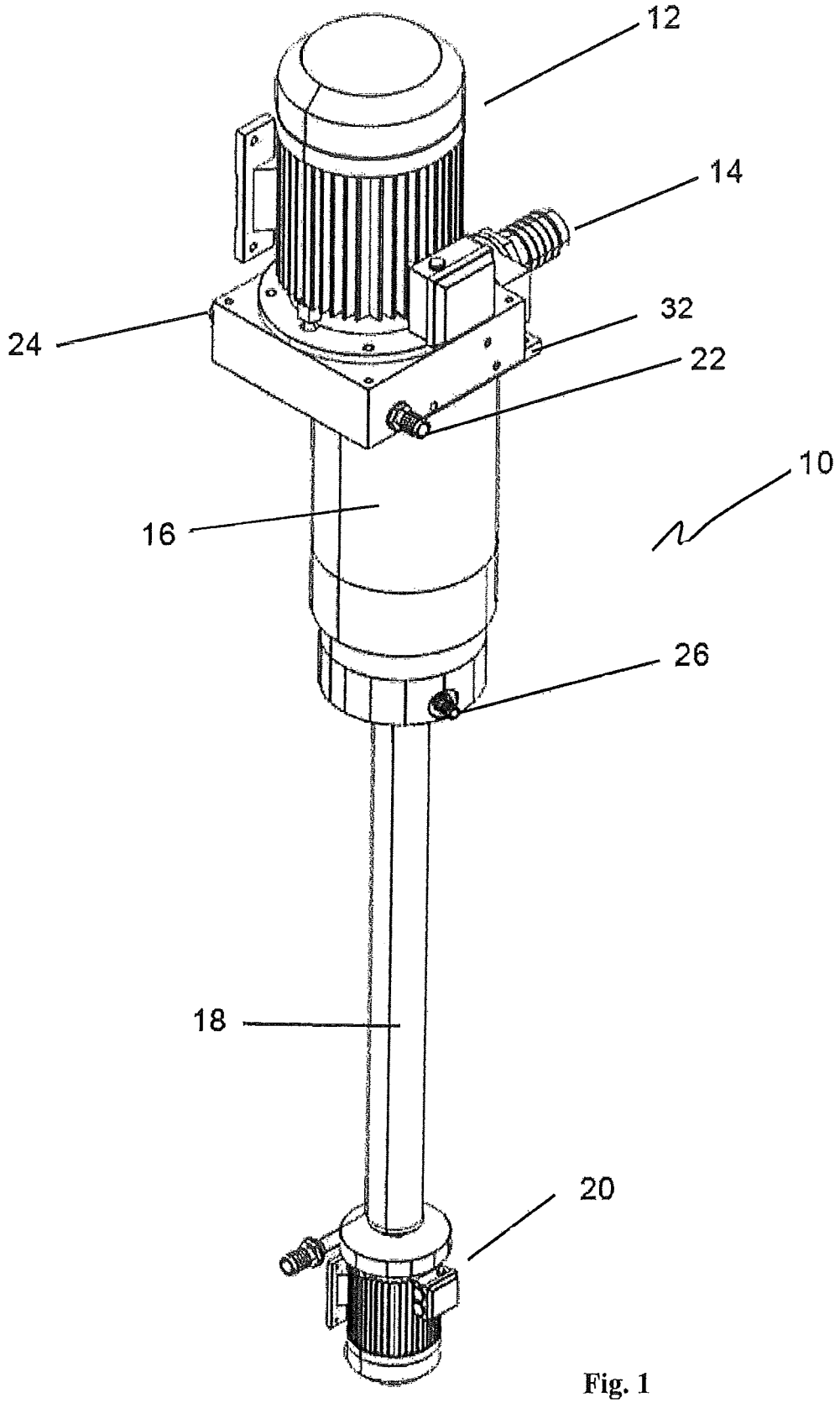
FIG. 1 is an overall view of the turbine and necessary components for operation.

The following detailed description of a preferred embodiment of the invention refers to the accompanying drawings. Wherever possible, the same reference numbers will be used throughout the drawings and the following description to refer to the same and like parts. As used herein, any usage of terms that suggest an absolute orientation (e.g. "top", "bottom", "front", "back", "horizontal", etc.) are for illustrative convenience and refer to the orientation shown in a particular figure. However, such terms are not to be construed in a limiting sense as it is contemplated that various components may in practice be utilized in orientations that are the same as, or different than those described or shown. Dimensions of certain parts shown in the drawings may have been modified and/or exaggerated for the purposes of clarity or illustration.

Referring to FIG. 1, the turbine 10 is an axial type with multiple stages in a first embodiment there being ten stages. The turbine includes a generator 12 and operates under steam delivered through inlet 14. The rotors and stators are located in housing 16 and the condensed water flows down pipe 18 where it is pumped out using conventional pump 20.

A gearbox connecting the shaft to the generator has an option to be cooled using water that enters though cooling inlet 22 and out through cooling outlet 24. Any remaining steam after it passes through the turbine is condensed using water entering though port 26.

Figure 2:
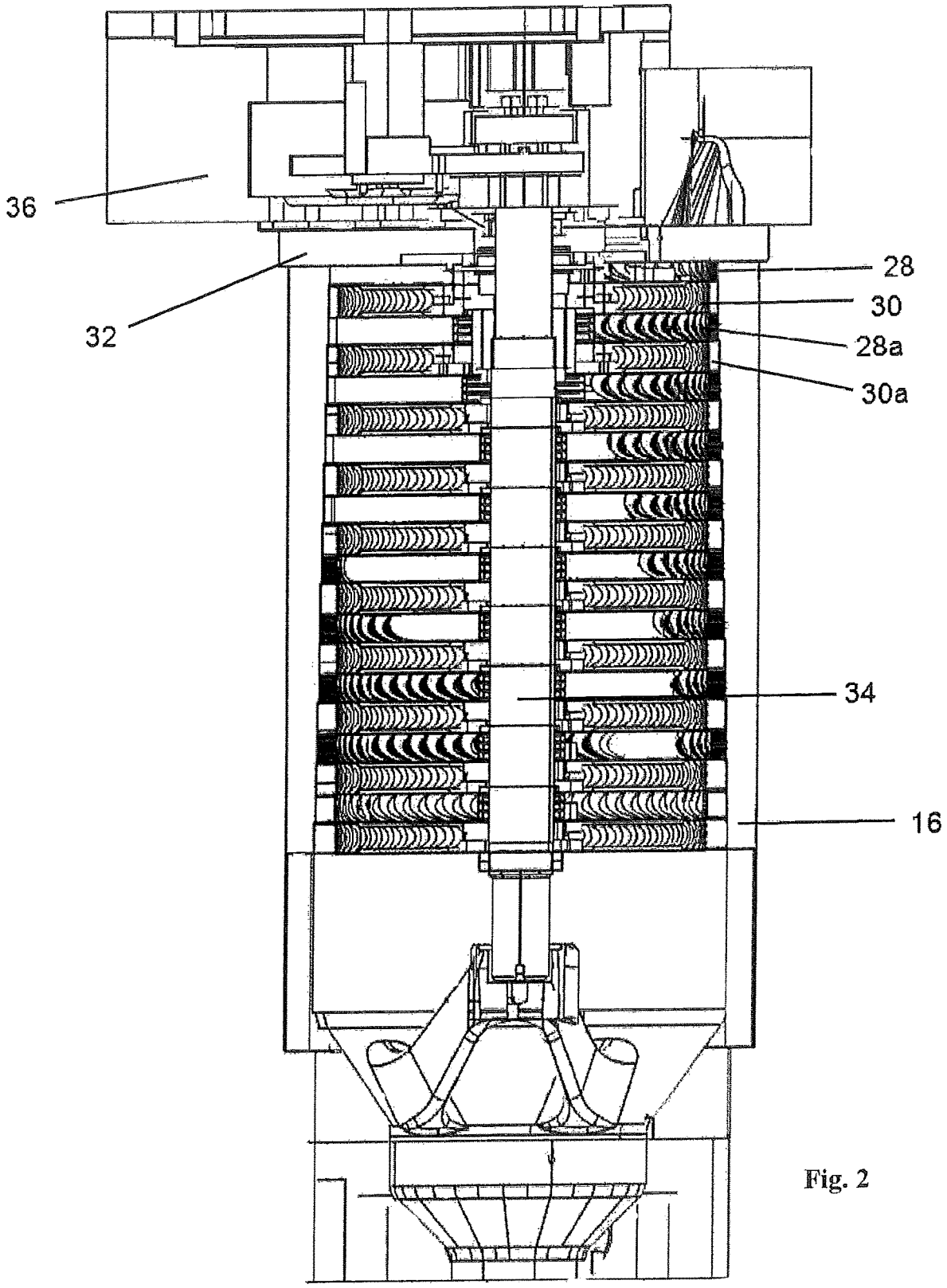
FIG. 2 is a wireframe view of the turbine and associated components.
Figure 3:
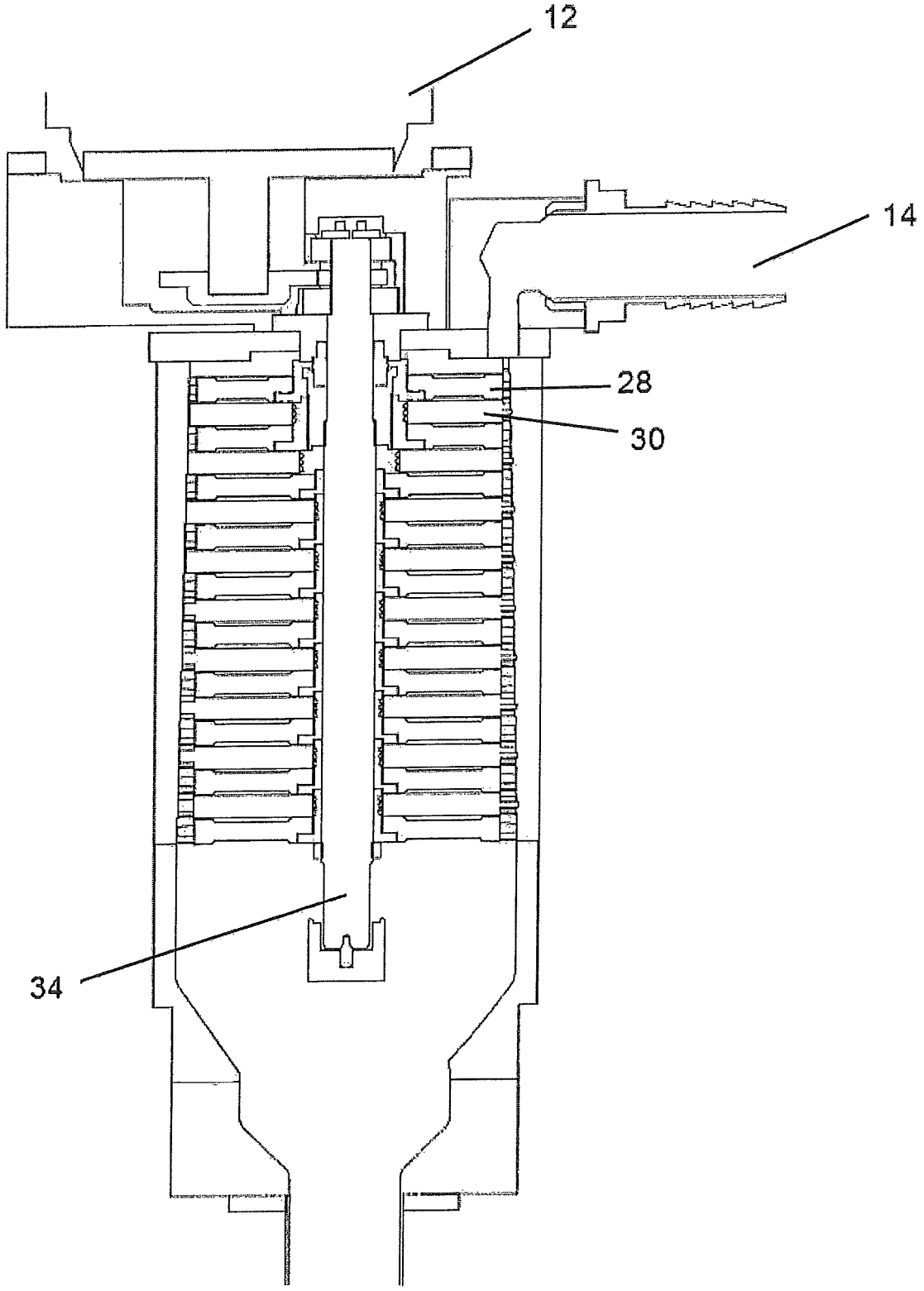
FIG. 3 is a section view of the turbine and associated components.

Illustrated in FIGS. 2 and 3 is a side and cross-sectional view of the turbine with the housing removed to show the stators and the rotors in an alternate arrangement there being a stator or nozzle 28 arranged on top of a blade or rotor 30, then a stator 28*a* on top of a rotor 30*a* and so on, there being a total of 10 stators and rotors each in this embodiment. The first nozzle stage 28 allows low pressure, non-superheated steam to be admitted only part way around the circumference and has a 90° inlet angle. Each subsequent set of nozzles increases admission until the last stage, which has complete admission. The second and subsequent nozzle sets each have identical, 2-dimensional profiles and inlet angles of 45°.

The rotor sets 30 are also composed of identical or near identical 2-D profiles, the height of which increases by −10% per stage. Each rotor and stator pair has the same blade root diameter, the blade tip diameter being slightly larger in the nozzles in each stage to allow the rotors clearance to the housing. The first nozzle is attached to the casing 32 each subsequent nozzle then attached to the housing 16 whilst the blades are attached to shaft 34 that provides power to generator 12 through a gearbox 36.

Figure 4:
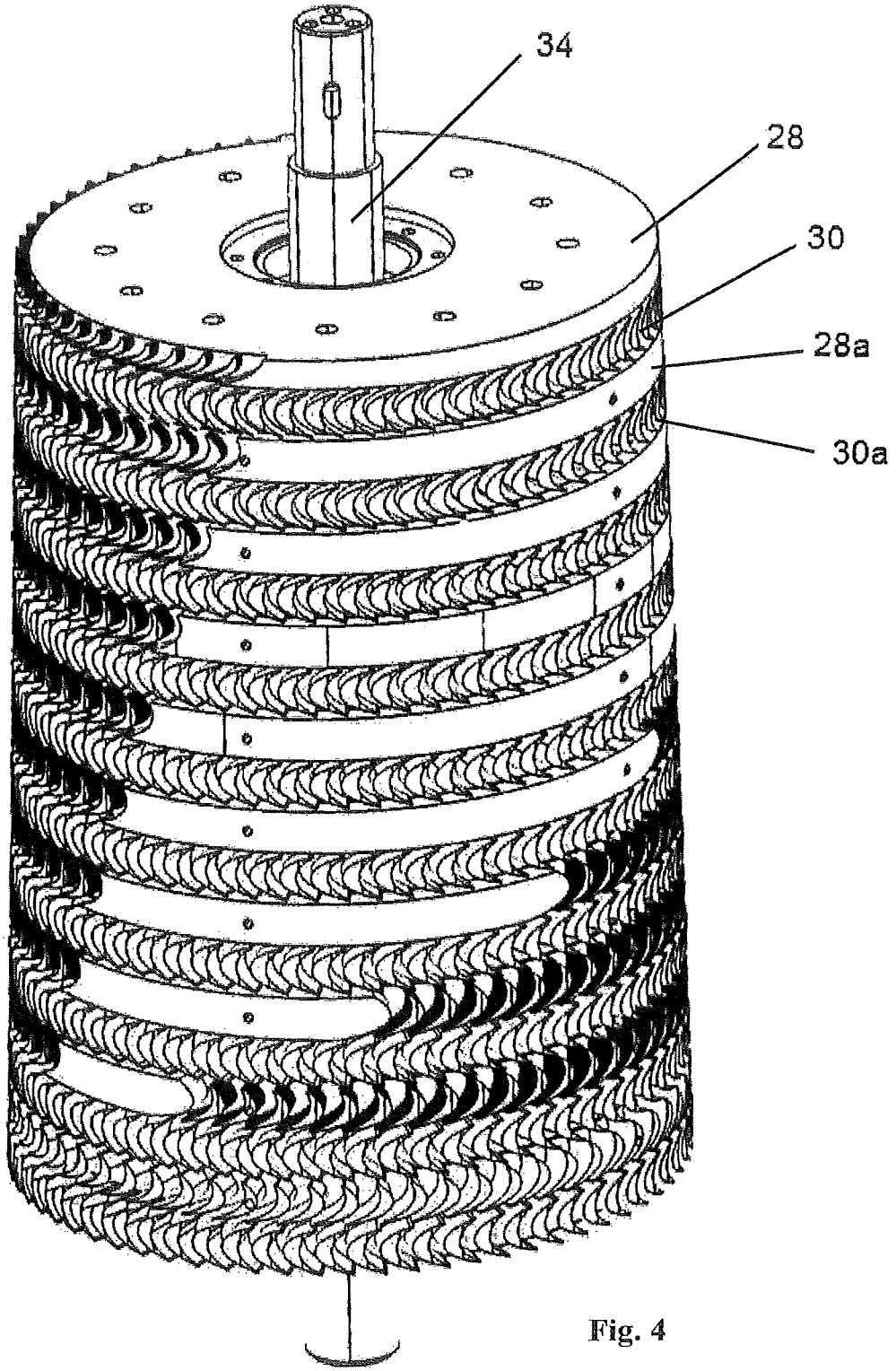
FIG. 4 shows the blade, nozzle and shaft assembly.
Figure 5:
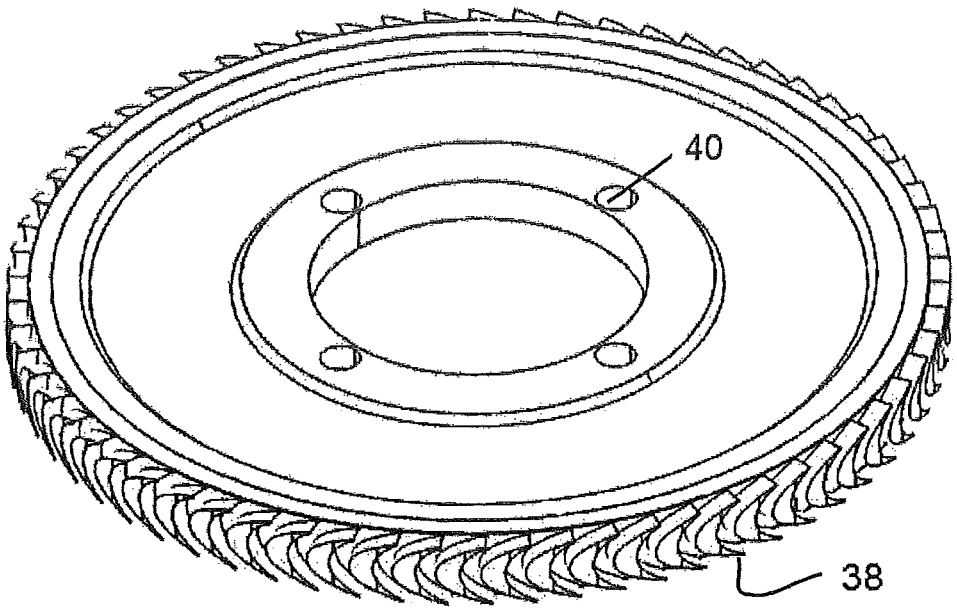
FIG. 5 is a view of the first blade stage.
Figure 6:
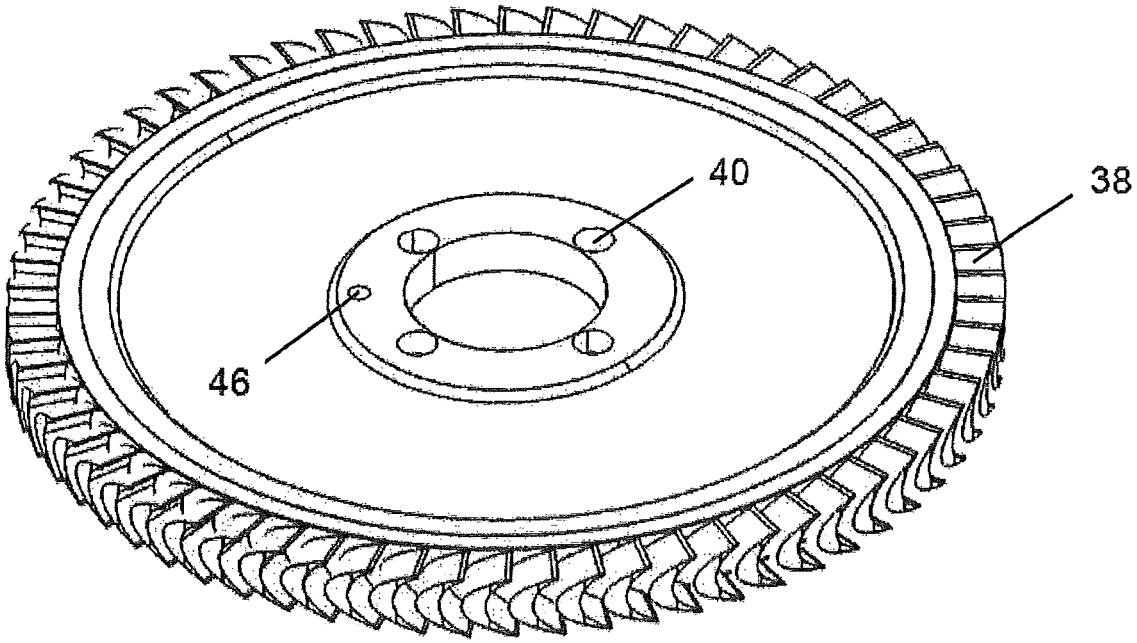
FIG. 6 is a view of the last blade stage.
Figure 7:
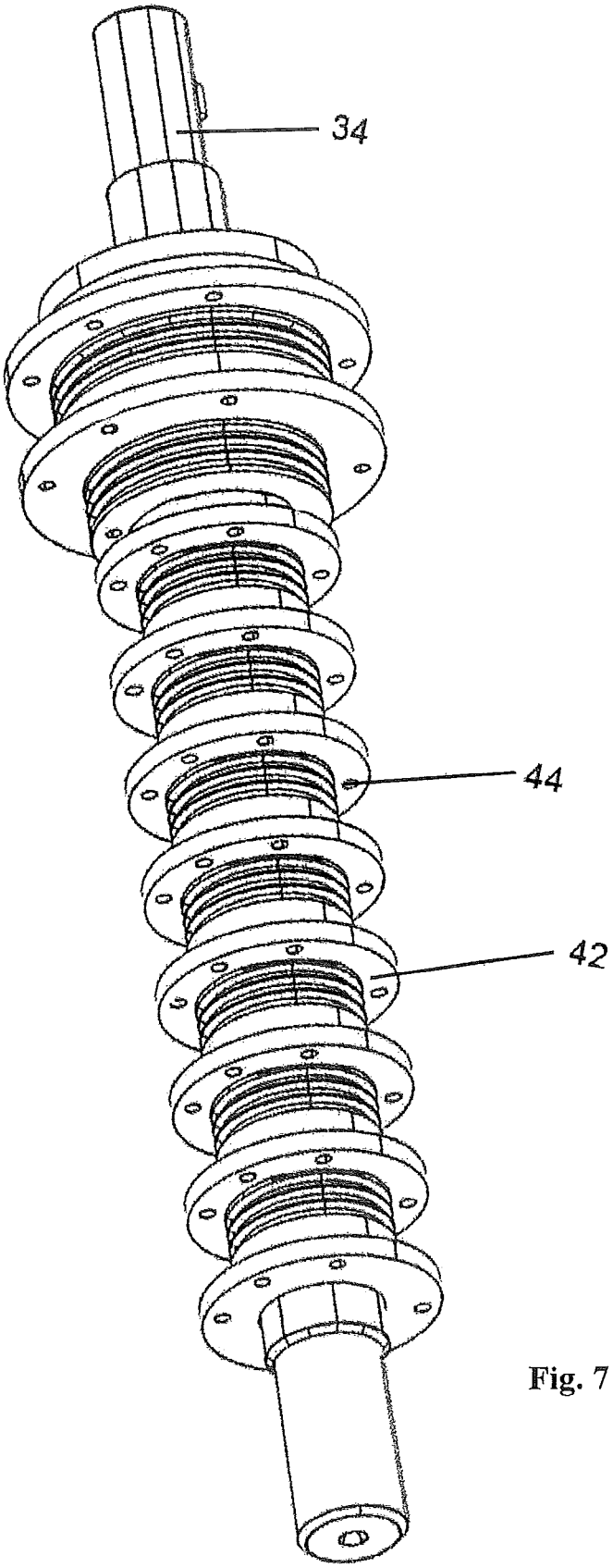
FIG. 7 is a view of the shaft assembled without the blade hubs.

A perspective view of the sandwich arrangement of the nozzles and blades is shown in FIG. 4 whilst the first blade is shown in FIG. 5 and the last blade in FIG. 6 illustrating the individual airfoils 38. Apertures 40 enable the blades to be attached to discs 42 having co-axial apertures 44 on the shaft 34 (FIG. 7). A locating hole 46 can be used to position blades on the shaft discs.

Figure 8:
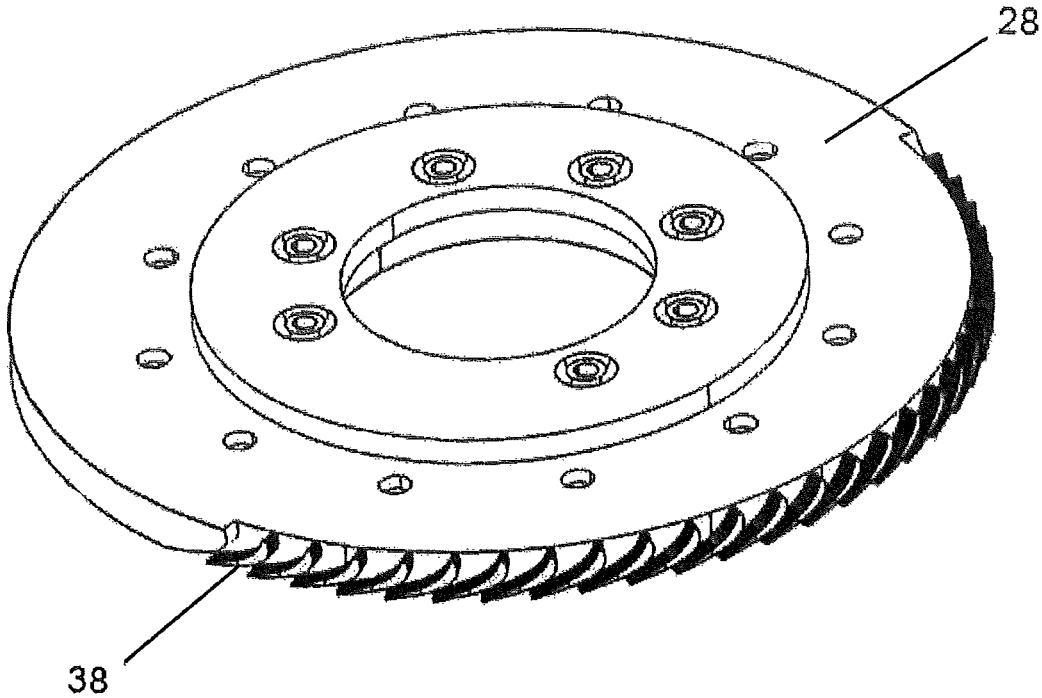
FIG. 8 is a view of the first nozzle stage.
Figure 9:
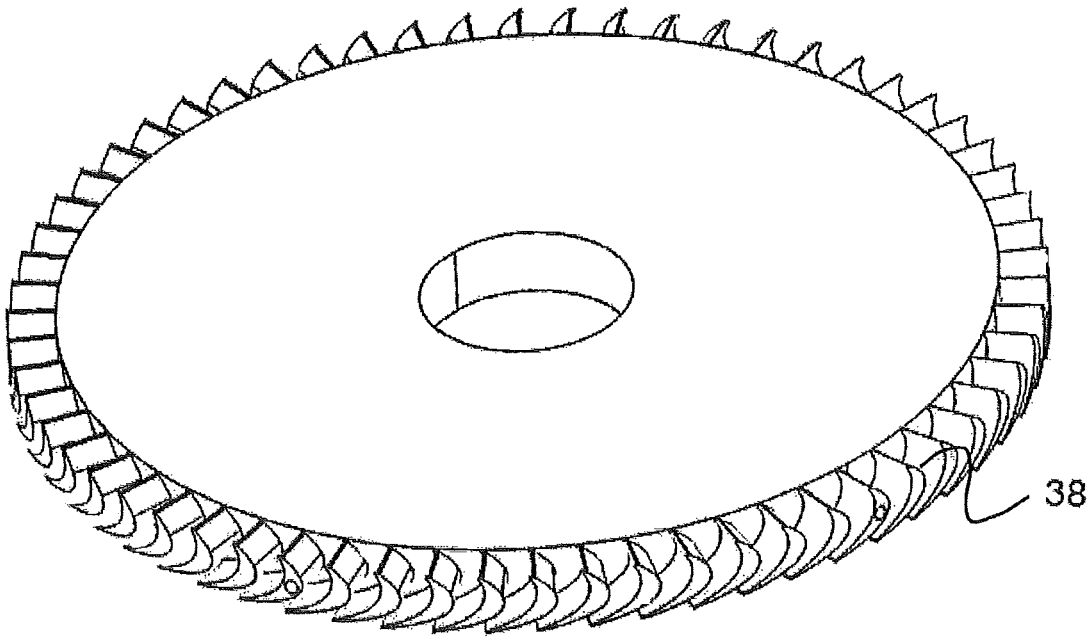
FIG. 9 is a view of the last nozzle stage.

FIGS. 8 and 9 illustrate the first and the last nozzles respectively. The first nozzle is attached to the casing 32 through apertures 48 whilst the rest are attached to the housing.

Figure 10:
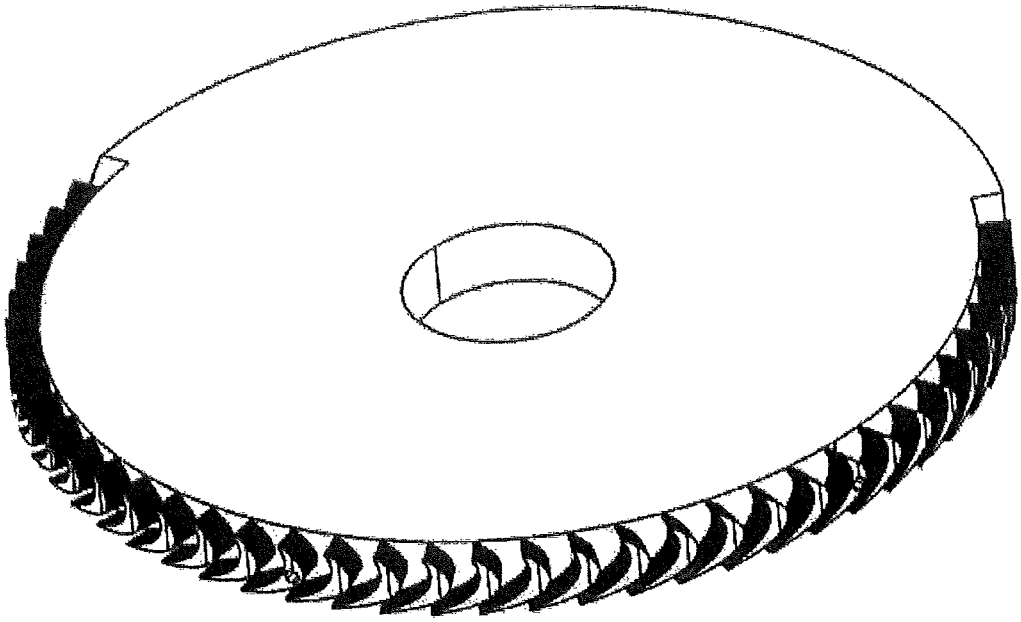
FIG. 10 is a view of the upper surface of an intermediate nozzle stage.
Figure 11:
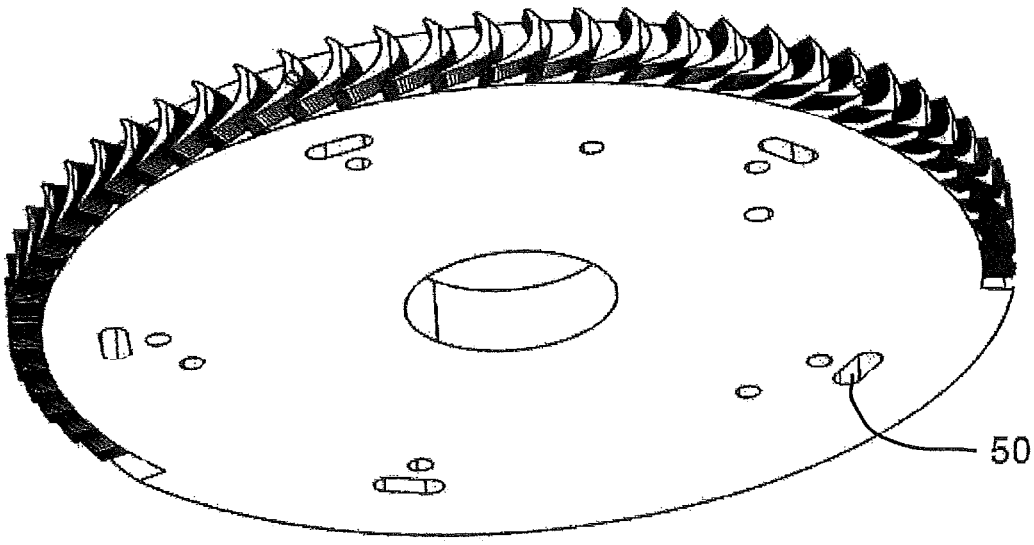
FIG. 11 is a view of the lower surface of an intermediate nozzle stage.
Figure 12:
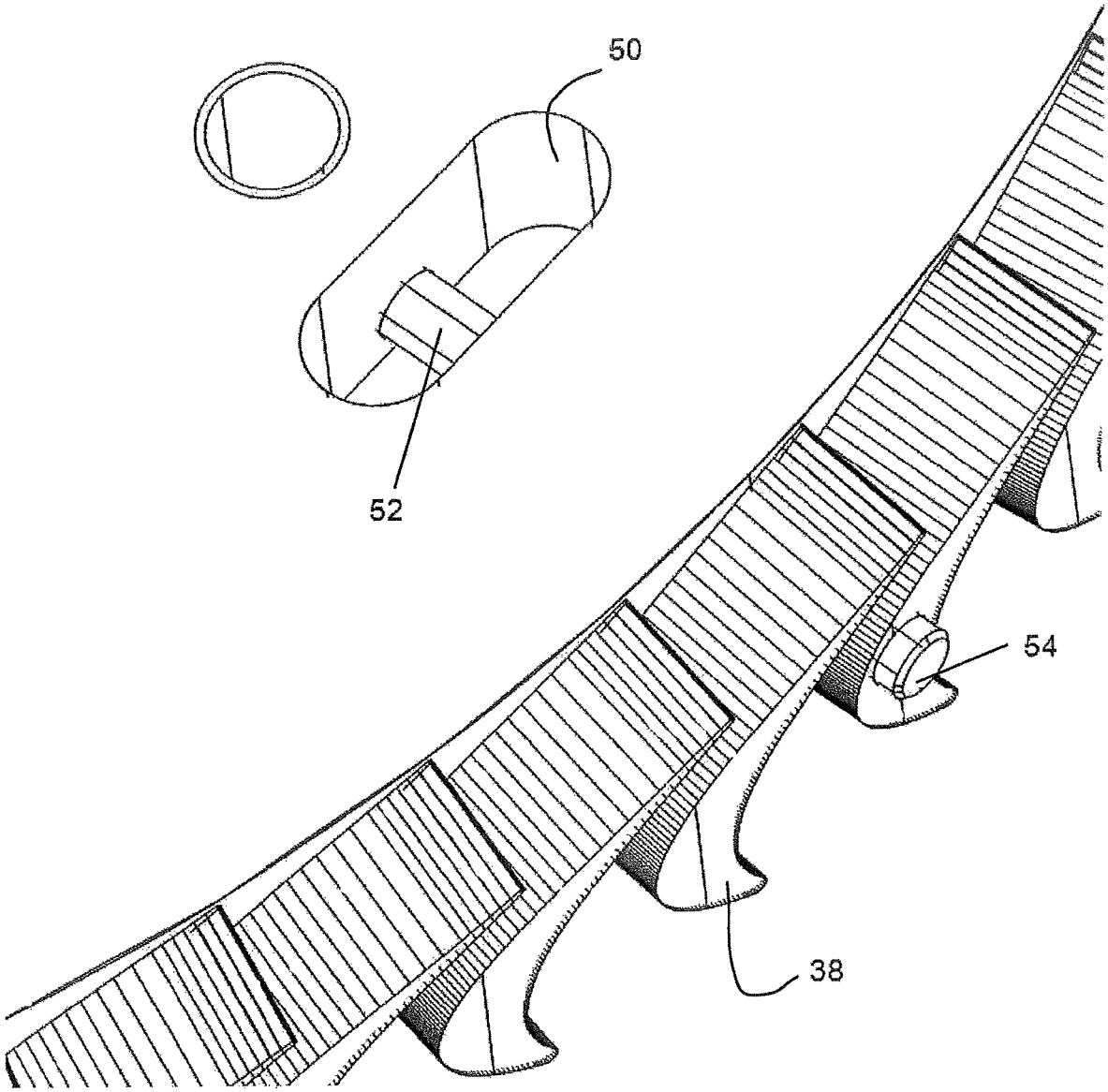
FIG. 12 is a detailed view of the nozzle securing mechanism.
Figure 13:
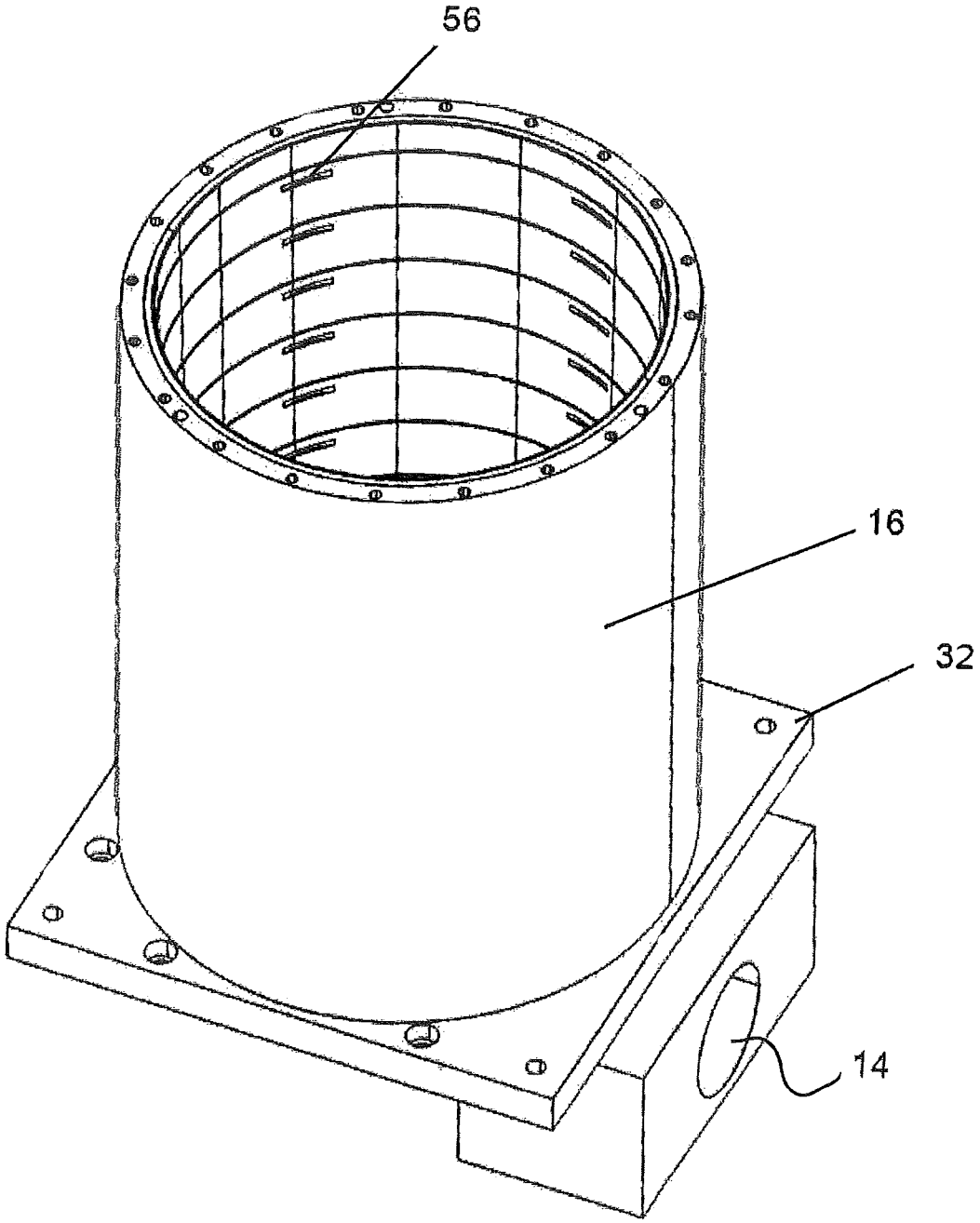
FIG. 13 is a view of the housing, showing the housing side nozzle retention interface.

Also illustrated are the airfoils 38. FIGS. 10 and 11 illustrates an intermediate stage nozzle, both a top and a bottom perspective view. The reader should appreciate that the intermediate stage has more airfoils than the first stage but less than the last. Referring to FIGS. 11, 12 and 13 on the underside of the nozzle are chambers 50. A rod 52 passes though the nozzle and an airfoil having a protrusion 54. That protrusion engages a slit 56 on the inside of the housing 16 the list varying in depth along its length. This enables the protrusion to be firmly wedged into the list and keeps the stator fixed to the housing. A grub screw is used within hole 58 to fix the rod in place.

Figure 14:
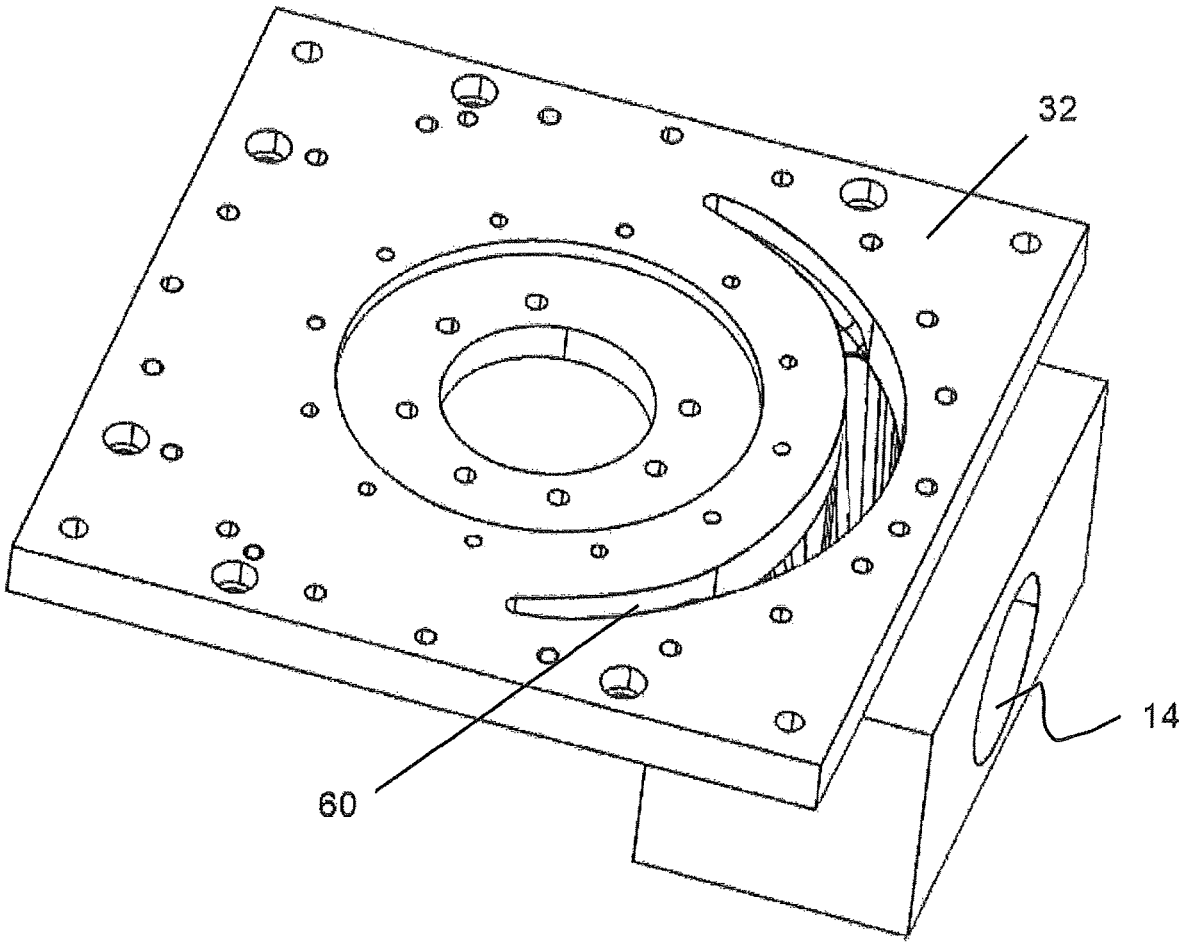
FIG. 14 is a view of the underside of the centreplate and nozzle block, showing steam inlet.
Figure 15:
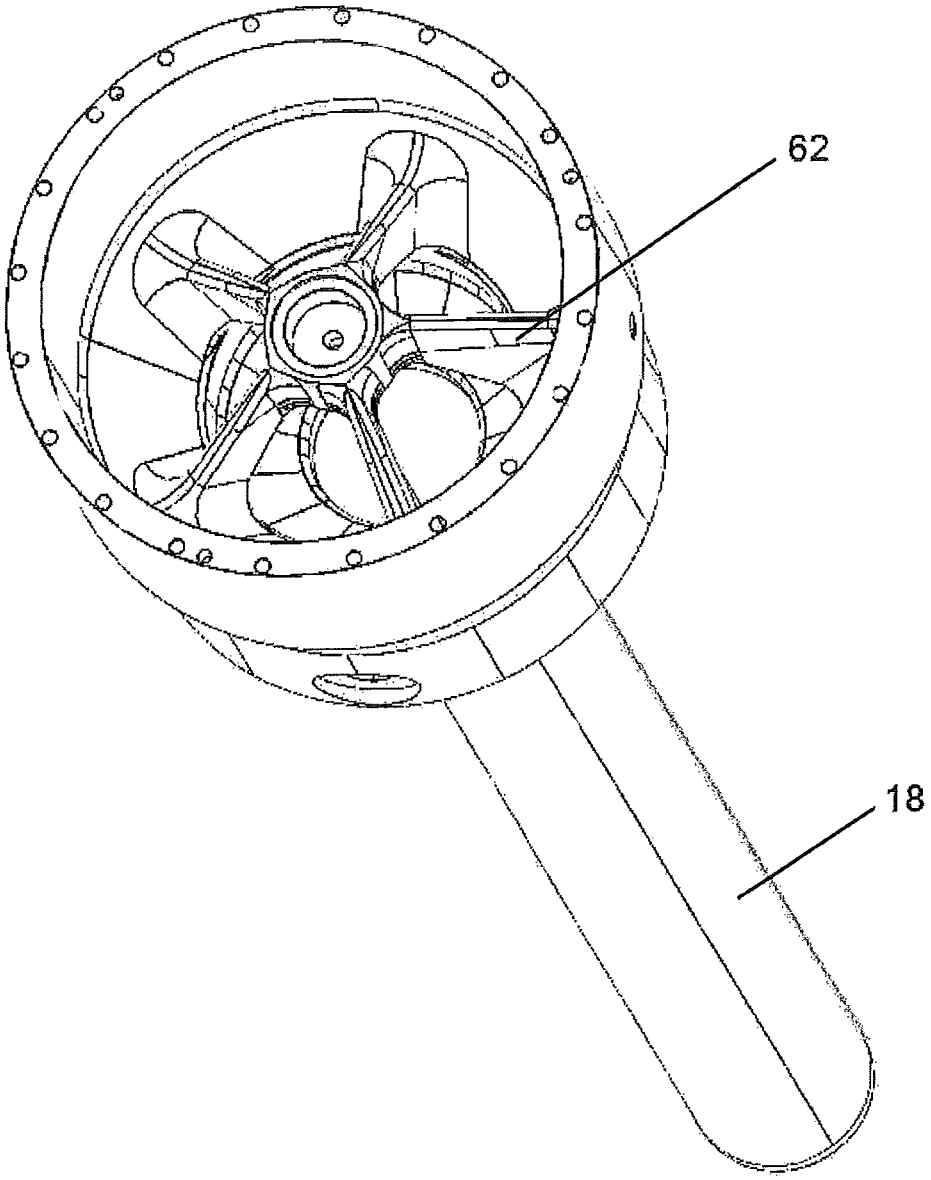
FIG. 15 is a view of the condenser, showing the water cooled bush and supports.

The first partial steam inlet 60 is shown in FIG. 14 whilst FIG. 15 illustrates the condensing system where the remnant steam is cooled by using water through bushes 62.

In a second embodiment, not illustrated, the turbine is an axial type with multiple stages, there being five stages. The first nozzle stage allows low pressure, non-superheated steam to be admitted only part way around the circumference and has a 90° inlet angle. Each subsequent set of nozzles increases admission until the last stage, which has complete admission. Each nozzle set has 2-dimensional profiles and inlet angles of 45°, the nozzle profile being identical within a nozzle stage but not necessarily identical to other nozzle stages.

To further assist the reader we wish to reiterate the working of the present invention. The housing is a single piece, of constant outer diameter and a stepped inner diameter to match the outer diameter of each stator set. Radial pins 52 through the stator blades are retracted so that the stator can be inserted into the housing. The stators locate against the housing steps to provide an initial axial position. The precise positioning is then afforded by extracting the radial pins into corresponding notches/slits in the housing which fix the stators both axially and circumferentially. A removable locking mechanism at the base of each pin secures the pin position and provides for pin retraction on disassembly.

The first rotor is secured directly to the shaft, with subsequent rotors having a series of interlocking hubs to locate the rotors axially and transmit torque. A locking after the last stage fixes the relationship between each rotor and the shaft in any orientation. A water cooled bushing at the exhaust end of the shaft reduces shaft play and whirl. Additional bushings between the stators and rotor hubs allow for clearance under normal operating conditions and thus introduce no losses but limit radial shaft deflections to sub-critical values.

Thus there is shown a multi-stage axial flow steam turbine, the stages contained within a turbine housing with no splits or seams in the axial direction, the turbine providing mechanical power to an electrical generator which is secured to the turbine by a gearbox assembly, this assembly also containing a centreplate and nozzle block, where the nozzle block forms part of a steam chest to supply the first stage nozzles with motive steam.

Steam exits the turbine in a straight line downwards, into a direct contact condenser where cooling liquid (typically water) is sprayed by a series of jets into the exhaust steam gases; the lower end of the turbine shaft is prevented from excess movement in a radial but not an axial direction by a water lubricated bush; condensate and cooling water are both removed (together with any non-condensable gases) from the lower end of the condensing tube stand pipe by a centrifugal pump, which also creates an operating exhaust side low pressure inside the condenser measurably lower than atmospheric pressure and approaching that of the partial vapour pressure of the cooling water.

The nozzle block extends partway around the turbine top and provides steam at an even pressure across the first nozzle (partial admission) stage through means of a steam chest. The first stator stage extends part way around the circumference of the turbine, providing partial steam admission (typically around 40%). This stage is secured to the centre plate by means of bolts. The first blade stage is secured directly to the shaft, subsequent blade stages being secured to the previous stage through the use of interlocking hubs which centralise each rotor on the shaft, transmit driving force to the shaft and ensure accurate Z axis positioning of each rotor in relation to the previous and subsequent stator stages.

The stators are secured to the turbine housing through means of a series of pins, which are retractable radially inward, into the nozzle vane supporting block positioned between each rotating blade. They can be retracted by means of removing a fastener at the base, providing a degree of freedom along its axis, a recess in the nozzle support blisk providing access for a means of manipulating the pin position. When in the extracted position the pin end locates into a slot, hole, bore or other feature in the turbine housing. In this manner the position of the stators are fixed axially and circumferentially with a high degree of dimension of accuracy (less than 0.2 mm).

With the pins retracted the stators can be sequentially inserted into the turbine housing. The housing is a single piece, with no splits or seams along its axial dimension. This greatly reduces manufacturing cost and the difficulty of producing an adequate partial vacuum seal (the prevailing pressure at each stage is typically less than atmospheric pressure). The internal bore of the housing is of nearly constant diameter. This is allowed for as each rotor and stator stage has a constant blade root diameter, with the blade height increasing by only −10% per stage. With the blade height small compared to the root diameter, the overall stage wise increase in total rotor/stator diameter is low. Expansion of steam through the turbine is allowed for by this slight increase in blade depth, additionally through each stator being of greater steam admission than the stage previous, with, typically, only the final stage or final two stages being 100% admission.

With each stage having minimal increases in blade height and the blade height being quite low in all stages, the operating conditions do not necessitate a 3-dimensional blade profile. This allows for each rotor and stator to be machined or cast as a single piece at low manufacturing cost. The single-part manufacturing techniques give further cost reductions through elimination of several assembly processes and results in a component that requires little or no rotational (dynamic) balancing. In addition, each stage has a constant pressure ratio which means that the same blade profile can be employed in every stage. This further improves manufacturing cost and ease by allowing the same tooling, material and process to be used throughout the manufacturing process of the Rotors and stators.

Additionally, the operating conditions of steam at low temperature and pressure allow for the use of lower-cost material in the blades, which are exposed to less mechanical and thermal stresses. Further to this, the lower tip speed which results from lower than typical rotational speeds and smaller diameters mean that manufacture of the blades and nozzles from aluminium or even some plastics is feasible, the rotational stresses becoming quite small. Eliminating the need to make the blades from a high strength/cost material allows the blades, nozzles, carriers and housing to be made of the same material, thereby reducing problems associated with differential thermal expansion of different materials during the operation of the turbine.

The turbine is orientated in such a way as to have its major axis being generally vertical. This provides the advantage of reducing the out-of-axis gravitational loads that occur on a horizontally-orientated turbine, these loads necessitating a bearing at intermediate locations on the shaft to reduce bowing which may allow for the turbine blade tips to contact the housing. These additional bearings are a major source of losses in lower powered turbines, often limiting the economic feasibility of low output systems. The bearings used in the present configuration are limited to a roller-element assembly in the gearbox which fixes the shaft location in both axial and radial directions, and a water-lubricated bush at the exhaust end which provides stability to the shaft, limiting only radial deflection and whirl; but absorbing no thrust in the Z axis.

The vertical orientation confers the further advantage of simplifying and optimising the exhaust arrangement. The turbine itself exhausts directly downwards into a direct-contact condenser with the assistance of gravity. The condensate and cooling water, delivered via downward facing jets positioned around the perimeter of the housing, mixes with lubricating water from the water-cooled bush (positioned just above the direct contact condenser) and collects in a vertically oriented stand pipe. The condensate is removed from the system by means of a conventional centrifugal pump. The arrangement of turbine exhaust, condenser, stand pipe and condensate removal pump allow the working fluids to exit the system partly under action of gravity, simplifying the overall system design and lessening the required pump work as well as providing a net positive suction head to the pump thus preventing cavitation at the entry point of the pump impeller. Additionally, the condensate removal pump is able to generate a pressure at the turbine exhaust which is substantially lower than atmospheric. This allows for the use of motive steam at low absolute pressure (as low as −4 psi G), as well as reducing the impact of aerodynamic drag and turbulence losses within the stages of the turbine.

The result of these various innovations is to permit the commercially viable and cost competitive production of a steam turbine with multiple stages ensuring sufficient efficiency to permit operation in a power band upwards from 1 kW to 25 kW. As an example, the closest known commercially available turbine (designed for operation exclusively on a limited number of refrigerant gases not including steam) is quoted with an output power of 150-250 kW at a cost of AU$450,000 not including the cost of a (estimated) 50 t condenser and a 25 t boiler, or a hermetically sealed circuit including a complex arrangement of reheating and condensing heat exchangers. The cost of this system would exceed an estimated $1.5 million. Fluid flows of up to 500 kg per second are required. After pumping losses the competitors system is estimated to produce no net power.

The equivalent cost of the system described is estimated in the range of less than $20,000 for a 20 kW turbine (net power) system; around one tenth of the cost of the competing system, adjusted for power output. Flow of steam for this system is approximately 60 g per second (steam) and 1 kg per second (cooling water), orders of magnitude lower than for the commercially available competitive system.

The reader will now appreciate the advantages of the present invention. The 10-stage partial admission turbine offers many advantages over conventional turbine designs.

Maximum efficiency is realized at lower shaft speeds (RPM) due to the special characteristic of partial admission stages for reaching peak efficiency at lower speed than the same stage with full admission. The nozzles and blades experience reduced stress levels due to:

(a) Smaller operating loads provided by reduced pressure drops per stage, (b) Small heights required to pass lower volume flows, and (c) And lower operating speeds required for maximum efficiency.

Reduced blade height variations from turbine inlet to exhaust results in a relatively smaller last stage diameter and enables the rotor to fit within a smaller casing diameter. The overall length is reduced due to close spacing of stages required for partial admission designs. Reduced manufacturing costs and machining times result due to:

(a) Reduced tool path depth required to machine the passages of the smaller blade heights, and (b) ability to use common nozzle and blade profiles in most stages.

Since there is a one piece housing there is simplified sealing whilst the blade profile is constant across the various stages due to the constant pressure ration for each stage. In addition the 2-D design of the blades requires simpler machining and drastically reduces assembly and since they operate under a less harsh environment can be manufactured from aluminium and even plastic.

The invention provides for the turbine to be operated with the shaft in a vertical orientation, which allows for the use of a lower number of and/or less specialised bearings. This lowers the overall cost per unit by several factors, namely; the reduced part cost, as less costly parts are used; reduced manufacturing cost, as the number of high tolerance manufacturing operations is lessoned; and reduced assembly cost, due to lowered component numbers and parts requiring precise location. There are also savings to be had in reducing required inventory and the like.

Further advantage is had through the motive fluid having a clear path from exiting the turbine and through the condenser. Eliminating the typical bends and other restrictions in this fluid path, as well as augmenting the fluid flow with gravitational force, results in a calculated power increase of 2%.

Through turbine operating vertically, as well as taking advantage of the reduced complexity of the condenser and associated plumbing, the footprint of the system is much reduced over conventional horizontal systems. This allows for greater flexibility of installation and a reduction in the floor area required for installation and operation, which reduces building and operating costs and increases the number of situations in which the system is practical and financially feasible.

The reader will now appreciate that, unlike conventional turbines, the present invention provides for a multi-stage axial turbine (typically between 4 and 10 stages) designed to operate more efficiently with partial admission in each stage except the last one or two stages. This is quite different from conventional turbines that endeavor to reduce the total number of stages required by designing each stage to accommodate a larger pressure drop. On the contrary, each stage of the subject turbine has been designed to operate efficiently with smaller pressure drops thereby maintaining much smaller reductions in fluid density per stage. Each subsequent stage then only requires a small increase in flow area that can be achieved by using only a small increase in admission and blade height.

The increase in steam temperatures, while allowing more energy to be extracted per unit mass of steam, requires high strength materials to be utilised, generally adding to the mass. Additionally, increasing the unit size complicates the operating conditions, such that a complex blade profile, which varies over the span of the blade, is typically required to achieve desirable operational characteristics and further necessitates a complex manufacturing process which generally precludes the turbine rotor assembly (bladed disc, or blisk) from being formed as a single piece.

A move to distributed power, or district energy, allows for much smaller outputs, while being able to utilise lower grade energy sources, which may also be more available at a distributed power location. For example, flash boiling steam in a partial vacuum enables the generation of dry, clean, saturated steam at temperatures of less than 100° C. This results in an internal operating environment that is far less mechanically damaging to the rotor blades and nozzles, allowing for the use of materials that have traditionally been unsuitable, such as aluminium or even some plastics.

Where a chosen turbo-machine design has a low overall blade height, again afforded by a comparatively low desired power output, the blade profile can be made to be constant along its span. The low blade depth and relatively simple blade shape results in a blade geometry that is capable of being formed by traditional machining techniques, while the capacity for the utilisation of softer materials combine to facilitate the manufacture of a blisk from a single piece of low cost material, providing a turbomachine that is an order of magnitude cheaper in manufacture than traditional individual blade/carrier wheel assemblies or the ECM process required for a similar product in a harder material.

The reader will now appreciate the present invention. Efficient operation has been specifically targeted for very low rotor tip speeds. Using partial admission in every stage but the last achieves a continuous increase in flow area from inlet to exhaust. This area increase is required to match the natural increase in volume flow that occurs as steam is expanding. Using partial admission in each stage minimises the required blade length changes between stages attaining a smaller casing diameter.

The same nozzle and rotor blade profile is used in each stage bar the first that requires a 90 degrees inlet angle as compared to 45 degrees for all others. The minimal change in blade lengths provides a reduced variation in velocity triangles from hub to tip allowing one to use a constant air foil profile from hub to tip.

The barrel type construction maintains an accurate alignment of all nozzles and rotor blades. The rotor may be constructed by shrinking individual bladed-discs onto a common shaft. The low top speed design together with low temperature operation allows the use of plastic material for each blisk, whilst the nozzles are constructed from aluminium.

The nozzle disc assemblies are sealed against the shaft using plastic bush seals to prevent steam leakage between adjacent stages able to take some impact from shaft oscillations. In contrast conventional designs use multiple labyrinth seal teeth that can easily be damaged from shaft oscillations and rotor excursions during start-up operations.

It is to be understood that reference to stators or rotors refers to blisks.

LIST OF COMPONENTS

Turbine 10
Generator 12
Steam inlet 14
Housing 16
Pipe 18
Pump 20
Cooling inlet 22
Cooling outlet 24
Port 26
Nozzle 28, 28*a*
Blade 30, 30*a*
Casing 32
Shaft 34
Gearbox 36
Airfoils 38
Apertures 40
Discs 42
Disc apertures 44
Locating hole 46
Nozzle apertures 48
Chamber 50
Rod 52
Protrusion 54
Slit 56
Hole 58
Partial steam inlet 60
Bushes 62

Further advantages and improvements may very well be made to the present invention without deviating from its scope. Although the invention has been shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatus. Any discussion of the prior art throughout the specification should in no way be considered as an admission that such prior art is widely known or forms part of the common general knowledge in this field.

In the present specification and claims (if any), the word "comprising" and its derivatives including "comprises" and "comprise" include each of the stated integers but does not exclude the inclusion of one or more further integers.

The invention claimed is:

1. An axial flow turbine for generation of electrical power, said turbine comprising:

multiple stages, wherein a stator and a rotor define each stage; wherein the stators and rotors are fabricated from aluminum or plastic; and wherein the turbine is configured for operation at low absolute pressure with the motive fluid being steam;

a partial admission inlet defined in a first stator of a first stage of the multiple stages, wherein the partial admission inlet admits a first amount of steam, each subsequent stage increasing the amount of steam admission in the corresponding stator until complete admission is achieved towards the final stages of the multiple stages; and the rotor in each stage having blisks; made as a single piece and steam passages built into the periphery of the blisks.

2. The axial flow turbine as in claim 1 wherein the turbine is orientated so that its major axis is generally vertical.

3. The axial flow turbine as in claim 2 wherein the rotor of each of the multiple stages is fixedly attached to a vertical shaft that is connected through a gearbox to an electrical generator.

4. The axial flow turbine as in claim 3 wherein the height of each rotor increases by about 10% per stage.

5. The axial flow turbine as in claim 1, wherein the turbine is configured for operation with steam that is at pressure as low as −4 PSIG.

6. The axial flow turbine as in claim 1, wherein the turbine is configured for operation with steam that is at a temperature of less than 100° C.

* * * * *